United States Patent [19]

Ramachandran

[11] Patent Number: 4,536,316

[45] Date of Patent: Aug. 20, 1985

[54] FABRIC SOFTENING COMPOSITION CONTAINING SURFACE MODIFIED CLAY

[75] Inventor: Pallassanna Ramachandran, Robbinsville, N.J.

[73] Assignee: Colgate-Palmolive Co., New York, N.Y.

[21] Appl. No.: 499,928

[22] Filed: Jun. 1, 1983

[51] Int. Cl.[3] ..... C11D 17/06; C11D 7/22; C11D 3/02; D06M 13/00

[52] U.S. Cl. ..... 252/174.11; 252/8.6; 252/8.8; 252/140; 252/174.25; 252/528; 252/547

[58] Field of Search ..... 252/8.6, 8.8, 547, 528, 252/140, 174.25, 174.11

[56] References Cited

U.S. PATENT DOCUMENTS

| | | | |
|---|---|---|---|
| 3,594,212 | 7/1971 | Ditsch | 117/62 |
| 3,681,241 | 8/1972 | Rudy | 252/8.75 |
| 3,862,058 | 1/1975 | Nirschl et al. | 252/113 |
| 3,886,075 | 5/1975 | Bernardino | 252/8.75 |
| 3,915,882 | 10/1975 | Nirschl et al. | 252/131 |
| 3,948,790 | 4/1976 | Speakman | 252/8.75 X |
| 4,062,647 | 12/1977 | Storm et al. | 252/174.25 X |
| 4,203,851 | 5/1980 | Ramachandran | 252/8.8 X |
| 4,292,035 | 9/1981 | Battrell | 252/8.6 X |

*Primary Examiner*—John E. Kittle
*Assistant Examiner*—Mukund J. Shah
*Attorney, Agent, or Firm*—Bernard Lieberman; Murray M. Grill; Herbert S. Sylvester

[57] ABSTRACT

A fabric softening composition is provided for use in admixture with a particulate detergent composition or as a softening additive to the wash solution separate from the detergent composition, such softening composition comprising: (i) discrete softening particles containing at least about 75%, by weight, of a smectite-type clay, and less than about 5%, by weight, of detergent surface active agents selected from the group consisting of anionic, nonionic, ampholytic and zwitterionic detergents; and (ii) a cationic compound selected from the group consisting of primary, secondary and tertiary amines and their water-soluble salts, diamine and diammonium salts, and quaternary ammonium, phosphonium and sulfonium compounds, substantially all of said cationic compound being adsorbed upon the surface of said particles.

29 Claims, No Drawings

FABRIC SOFTENING COMPOSITION CONTAINING SURFACE MODIFIED CLAY

BACKGROUND OF THE INVENTION

This invention relates to fabric softening compositions for use in laundering operations. More particularly, this invention relates to improved fabric softening compositions containing a smectite-type clay and a quaternary ammonium compound which provide improved softening effects.

The use of clays in combination with quaternary ammonium compounds (also referred to herein as "QA" compounds for convenience) is extensively described in the prior art. U.S. Pat. No. 3,886,075, for example, describes a composition containing a smectite clay, a water-insoluble QA compound and an "amino compatibilizing agent" which is said to provide fabric softening and anti-static effects. U.S. Published Patent Application No. B 305,417 describes a granular laundering composition comprising a soap-based granule, a smectite-type clay and a quaternary ammonium anti-static agent. In U.S. Pat. No. 3,862,058, a clay and a quaternary ammonium compound are added to a non-soap synthetic detergent compound to provide a granular laundry detergent composition. U.S. Pat. Nos. 3,993,573 and 3,954,632 describe fabric softening compositions containing the aforementioned clay and QA compounds in combination with a so-called "acid compatibilizing agent". U.S. Pat. No. 4,292,035 discloses a softening composition comprising smectite clay; an amine or quaternary ammonium compound as a softening agent; and an anionic surfactant wherein the fabric softening agent is reacted with the clay to form an "organo-clay complex" prior to the addition of the anionic surfactant.

A common drawback of the aforementioned softening compositions of the prior art is that they require unduly high concentrations of QA compounds to achieve the desired softening effect. Thus, for example, in the detergent compositions described in the examples of U.S. Pat. Nos. 3,862,058; 3,954,632 and 3,993,573, the weight ratio of clay to QA compound is about 5:1. In U.S. Pat. No. 3,948,790 and Published Application No. B 305,471, the examples describe detergent compositions containing 5%, by weight, of QA compound. The use of such relatively high concentrations of QA compound in the aforementioned compositions of the prior art has two distinct drawbacks: first, since QA compounds are relatively expensive softening agents compared to clay, it is economically desirable to provide the desired softening properties using a minimum amount of QA compound relative to the clay in the laundry composition; and second, the QA compounds being cationic are capable of reacting with anionic detergents and brighteners present in detergent compositions, such reactions being preferably avoided insofar as they may inactivate the fabric softener or adversely affect the laundering capability of the composition. Consequently, there is a need in the art for fabric softening compositions containing minimized amounts of QA compounds but still capable of providing the desired degree of fabric softening.

Achieving the aforementioned objective is particularly desirable for laundering compositions intended for use in a soak plus hand-wash operation as compared to laundry operations in a washing machine. In the latter operation, clay is inherently more effective as a softening agent insofar as it comes into contact with and is deposited upon the surface of the fabric being laundered during the wash cycle of the machine when the washing bath is mechanically drained through the fabric. However, in a hand-wash procedure where the mechanical action is not sufficient to effect a similar degree of contact between the fabric and the clay, significantly larger amounts of clay and QA compound must be employed to achieve comparable softening of the fabrics being laundered.

The methods described in the art for preparing the aforementioned fabric softening compositions are varied. However, a common characteristic of such processes is their difficulty in being able to produce a composition capable of providing the desired degree of fabric softening using minimized amounts of clay and QA compound. The preparation techniques of the prior art are thus characterized by either a deposition of QA compound upon granules composed of a uniform blend of clay with detergent and other ingredients (rather than a preferential deposition upon clay granules) or alternatively, the QA compound is reacted with the clay to provide a modified clay in which preferably from about 10 to about 60 mole percent of the exchangeable cations are alkyl substituted ammonium ions. Thus, for example, U.S. Pat. Nos. 3,862,058 and 3,886,075 describe a method of preparation whereby the clay is initially admixed in a crutcher with the detergent, builder and other ingredients of the laundering composition and the resulting mixture then spray-dried to form granules. The QA compound is thereafter sprayed upon the granules from a melt, it being a critical aspect of the method of preparation to avoid spraying the detergent granules with an aqueous solution or suspension of the QA compound. U.S. Published Patent Application No. B 305,417 discloses a method of preparation wherein clay is mixed with soap-based granules in a drum mixer. The QA compound is then added to the resulting composition by spraying from a melt. U.S. Pat. No. 3,594,212 describes a method of softening fibrous materials wherein such materials are successively impregnated with an aqueous dispersion of clay and an aqueous solution of QA compound, the amount of QA compound in solution being sufficient to effect at least a partial cation exchange with the clay retained on the fibrous material. In U.S. Pat. No. 3,948,790 to Speakman, there is described a procedure for preparing "quaternary ammonium clays" whereby a QA compound is reacted with clay by slurrying the untreated clay in a solution containing the desired quantity of QA compound. The QA compounds which may be thus employed are said to be restricted to short-chain compounds having a maximum of four carbon atoms per chain, the total number of carbon atoms in the compound not exceeding eight. The quantity of such QA compound added to the solution is controlled so as to provide the desired degree of ion exchange with the clay. The examples of the patent describe various treated clays in which from about 5 to 40% of the exchangeable cations are replaced by quaternary ammonium cations, the amount of QA compound in solution being necessarily restricted to that which is required to effect a partial exchange reaction with the clay. Accordingly, the prior art does not contemplate the formation of a surface modified clay as herein described.

SUMMARY OF THE INVENTION

The present invention provides an improved fabric softening composition comprising (i) discrete softening particles containing at least about 75%, preferably at least 90%, by weight, of a smectite-type clay, and less than about 5%, by weight, of detergent surface active agents selected from the group consisting of anionic, nonionic, ampholytic and zwitterionic detergents; and (ii) a cationic compound selected from the group consisting of primary, secondary and tertiary amines and their water-soluble salts, diamine and diammonium salts, and quaternary ammonium, phosphonium and sulfonium compounds, substantially all of said cationic compound being adsorbed upon the surface of said softening particles.

The term "softening particles" as used throughout the specification and claims is intended to encompass a wide variety of particulate matter of differing shape, chemical composition, particle size and physical characteristics, the essential common characteristic being that such softening particles contain at least 75%, and preferably at least 90%, by weight, of a smectite-type clay, the primary softening ingredient in the softening compositions of the invention. The weight percent of the "smectite-type clay" refers to the weight of the smectite clay minerals (e.g., montmorillonite) as well as the water and impurities associated with the particular clay employed. Accordingly, the softening particles may be in the form of finely divided powders, as well as relatively larger-sized granules, beads or agglomerated particles, and may be produced by diverse methods of manufacture such as spray-drying, dry-blending or agglomeration of individual components. Particularly preferred softening particles for use herein are bentonite agglomerates produced by the method described in U.S. Ser. No. 366,587, filed Apr. 8, 1982, now U.S. Pat. No. 4,488,972, the disclosure of which is incorporated herein by reference. The softening particles may thus optionally include in addition to the smectite-type clay, materials which do not interfere with the desired fabric softening or with laundering, in general, examples of suitable materials including binding or agglomerating agents, e.g., sodium silicate, dispersing agents, detergent builder salts, filler salts as well as common minor ingredients present in conventional laundry detergent compositions such as dyes, optical brighteners, anti-redeposition agents and the like. For purposes of the invention, the softening particles should contain less than about 5%, by weight, of surface active detergent compounds other than a cationic detergent, preferably less than about 3%, by weight, and most preferably are substantially free of anionic, nonionic, ampholytic and zwitterionic detergents.

The term "discrete" as used herein with regard to the softening particles refers to the fact that such particles are employed in the present invention as individually distinct particles, thus excluding, for example, softening particles which are encompassed within a matrix of other materials, or which are blended with other ingredients such that the particles become a component of a larger aggregate material rather than being in the form of individual and distinct particles.

The cationic compounds suitable for the invention encompass the aforementioned compounds all of which are capable of providing a cationic surface to particles of a smectite-type clay when such compounds are adsorbed upon the surface of the clay particles as herein described. Quaternary ammonium compounds are especially preferred for this purpose.

In accordance with the process of the invention, the above-defined fabric softening composition is prepared by a process comprising the steps of (a) providing softening particles containing at least about 75%, by weight, of a smectite-type clay and less than about 5%, by weight, of surface active detergent compounds other than cationic detergents; and (b) contacting said particles with a cationic compound such that substantially all of said cationic compound is adsorbed upon the surface of said particles and forms at least a partial coating thereupon.

The step of contacting the softening particles in the above-described process of preparation is directed to methods of depositing a cationic compound upon the surface of the clay-containing particles rather than methods of effecting a reaction between such cationic compound and the clay. Thus, the process of the invention is concerned with avoiding the transformation of a major portion of the clay to a complex by an ion exchange reaction, thereby excluding, for example, the methods of preparing a "QA clay" and an "organo-clay complex" referred to in U.S. Pat. Nos. 3,948,790 and 4,292,035, respectively. To promote the adsorption of a cationic compound upon the surface of the softening particles, process conditions which favor swelling of the smectite-type clay are generally avoided so as to minimize the likelihood of an undesired exchange reaction between the clay and the cationic compound. Swelling of the clay is particularly favored in an aqueous slurry, hence, the less water which contacts the clay, the less the likelihood of effecting a cation exchange reaction. Accordingly, the weight of aqueous solution which contacts the softening particles in the method of preparation of the invention is generally restricted to an amount less than the weight of the softening particles, preferably below 50% and more preferably below 25%, by weight, of such particles.

A preferred method of preparation comprises spraying the surface of the softening particles with a substantially non-aqueous solution or suspension containing the cationic compound, the concentration of water in such solution or suspension being maintained generally below about 50%, by weight, and preferably below about 10%, by weight. This is conveniently effected by spraying the solution or suspension of cationic compound from a pressurized nozzle so as to produce droplets or a fine mist which contact the surface of the particles, the latter being conveniently on a moving belt, such as a conveyor belt. The range of suitable droplet size may vary widely from about 10 to about 250 microns in diameter, but preferably should be as small as possible relative to the diameter of the particles being sprayed. Spraying is preferably carried out at ambient temperatures and generally below 100° F. At temperatures above 100° F., particularly above 140° F., the cationic compounds may be undesirably absorbed into the softening particles rather than remain as a coating upon the particle surface where it is believed to provide the optimum softening effect. Any organic solvent in which the cationic compound can be dispersed may be conveniently employed to form a solution or suspension for contacting the softening particles. Useful solvents include propylene glycol, hexylene glycol, ethanol and isopropyl alcohol.

The present invention is characterized by effective softening compositions which contain minimized concentrations of QA compound relative to clay. The invention is predicated upon a method of preparation wherein substantially all of the cationic compound used for softening is contacted with the softening particles as herein described rather than, as disclosed in the prior art, upon granules of a detergent composition wherein the clay is only a relatively minor component, usually less than about 12% of the detergent granule. Thus, the method of the invention provides for a preferential deposition of QA compound upon clay. Moreover, unlike the methods of preparation described in the art wherein a slurry of clay is formed in a solution of QA compound to effect an ion exchange reaction therebetween, the present invention provides a surface-modified softening particle by a method of preparation which minimizes the likelihood of ion exchange between the clay and the cationic compound, and instead, promotes the formation of at least a partial surface coating of cationic compound upon the clay particles by adsorption. This has the effect of maximizing the softening properties which can be provided by the given amount of clay and cationic compound employed. The surface modified particles are generally hydrophobic in nature, the clay itself being hydrophilic. The hydrophobicity of the particles is particularly advantageous in hand-wash laundering operations because the hydrophobic particles are not as readily dispersable in the aqueous hand-wash solution as untreated clay and, therefore, tend to remain upon the surface of the wash solution for longer periods of time. This has the effect of enhancing the availability of such particles for contact with and deposition upon the fabrics being laundered. Thus, the present compositions are capable of providing improved softening effects, particularly for soak plus hand-wash operations, but at reduced concentrations of cationic compounds in the softening composition.

Although the applicant does not wish to be bound to any particular theory of operation, it is believed that the improved fabric softening achieved with the compositions of the present invention is primarily attributable to the surface modification of the clay-containing particles. Specifically, the deposition of a cationic compound upon the particle surface provides a positive charge to such particle thereby creating a driving force for the positively charged particles of clay to attach themselves to the negatively charged surface of the fabrics being laundered, and particularly to fabrics containing substantial amounts of cotton. The amount of cationic compound required to impart such surface charge is relatively minor, the surface modified particles providing no significant antistatic effect such as said to be provided by the aforementioned compositions of clay and QA compounds known in the art. Thus, it is believed that the cationic compounds in the compositions of the invention serve primarily to impart a positive surface charge to the particles of clay, and consequently, only relatively minor amounts of cationic compounds are required for the present compositions compared to softening compositions known in the art.

The fabric softening compositions of the invention contain two essential ingredients: softening particles and a cationic compound. The weight ratio of the softening particles to cationic compound in the composition is generally from about 500:1 to about 10:1, and preferably from about 200:1 to about 25:1. Such compositions may be conveniently employed during home laundering as additives to a laundry detergent composition. Alternatively, the present invention contemplates incorporating the above-defined softening compositions into a conventional laundry detergent composition to form a fully-formulated laundry detergent composition which contains as a component thereof a softening composition as defined hereinabove in combination with an organic detergent compound, a detergent builder salt and other components optionally present in conventional laundry compositions. The addition of such a fully formulated laundering composition to water produces a laundering bath capable of providing the desired degree of cleaning and softening of soiled and/or stained fabrics.

DETAILED DESCRIPTION OF THE INVENTION

The fabric softening compositions of the invention are suitable as additives to or components of a granular laundry detergent composition or alternatively improved softening may be effected by adding the softening compositions to the wash solution separately from the detergent composition, such as, for example, during the rinse cycle of a washing machine. The softening compositions comprise (a) discrete softening particles containing at least 75%, by weight, of a smectite-type clay and (b) a cationic compound, the ratio of (a) to (b) being generally from about 500:1 to about 10:1, preferably from about 200:1 to about 25:1, and most preferably from about 100:1 to about 40:1.

The fully formulated laundry detergent composition of the invention contains as a component thereof a fabric softening composition as defined hereinabove in combination with an organic detergent compound, a detergent builder salt and other components such as binders, fillers, brighteners, perfumes, dyes, foam stabilizers, anti-redeposition agents and the like which are optionally present in laundry compositions. Accordingly, such laundry detergent compositions generally comprise (a) from about 3 to about 50%, by weight, of a fabric softening composition comprising (i) discrete softening particles containing at least about 75%, by weight, of a smectite-type clay, and less than about 5%, by weight, of surface active detergent compounds other than cationic detergents; and (ii) a cationic compound selected from the group consisting of primary, secondary and tertiary amines and their water-soluble salts, diamine and diammonium salts, and quaternary ammonium, phosphonium and sulfonium compounds, substantially all of said cationic compound being adsorbed upon the surface of said particles and forming at least a partial coating thereupon; (b) from about 2 to about 50%, by weight, preferably from about 5 to about 30%, by weight, of a surface active detergent compound selected from the group consisting of anionic, nonionic, cationic, ampholytic and zwitterionic detergents; and (c) from about 1 to about 70%, by weight, of a detergent builder salt.

The smectite-type clays of the invention are three-layer clays characterized by the ability of the layered structure to increase its volume several-fold by swelling or expanding when in the presence of water to form a thixotropic gelatinous substance. There are two distinct classes of smectite-type clays: in the first class, aluminum oxide is present in the silicate crystal lattice; in the second class, magnesium oxide is present in the silicate crystal lattice. Atom substitution by iron, magnesium, sodium, potassium, calcium and the like can occur within the crystal lattice of the smectite clays. It is customary to distinguish between clays on the basis of their predominant cation. For example, a sodium clay is one in which the cation is predominantly sodium. For purposes of the present invention, aluminum silicates wherein sodium is the predominant cation are preferred, such as, for example, bentonite clays. Among the bentonite clays, those from Wyoming (generally referred to as western or Wyoming bentonite) are especially preferred.

Preferred swelling bentonites are sold under the trademark Mineral Colloid, as industrial bentonites, by Benton Clay Company, an affiliate of Georgia Kaolin Co. These materials which are the same as those formerly sold under the trademark THIXO-JEL, are selectively mined and beneficiated bentonites, and those considered to be most useful are available as Mineral Colloid Nos. 101, etc, corresponding to THIXO-JELs Nos. 1, 2, 3 and 4. Such materials have pH's (6% concentration in water) in the range of 8 to 9.4, maximum free moisture contents of about 8% and specific gravities of about 2.6, and for the pulverized grade at least about 85% (and preferably 100%) passes through a 200 mesh U.S. Sieve Series sieve. More preferable, the bentonite is one wherein essentially all the particles (i.e., at least 90% thereof, preferably over 95%) pass through a No. 325 sieve and most preferably all the particles pass through such a sieve. The swelling capacity of the bentonites in water is usually in the range of 3 to 15 ml/gram, and its viscosity, at a 6% concentration in water, is usually from about 8 to 30 centipoises.

In a particular preferred embodiment of the invention, the softening particles comprise agglomerates of finely divided bentonite, of particle sizes less than No. 200 sieve, agglomerated to particles of sizes essentially in the Nos. 10–100 sieve range, of a bulk density in the range of 0.7 to 0.9 g./ml. and a moisture content of 8 to 13%. Such agglomerates include about 1 to 5% of a binder or agglomerating agent to assist in maintaining the integrity of the agglomerates until they are added to water, in which it is intended that they disintegrate and disperse. A detailed description of the method of preparation of such agglomerates is set forth in the aforementioned U.S. Ser. No. 366,587, filed Apr. 8, 1982 now U.S. Pat. No. 4,488,972 which is incorporated herein by reference.

Instead of utilizing the THIXO-JEL or Mineral Colloid bentonites one may employ products, such as that sold by American Colloid Company, Industrial Division, as General Purpose Bentonite Powder, 325 mesh, which has a minimum of 95% thereof finer than 325 mesh or 44 microns in diameter (wet particle size) and a minimum of 96% finer than 200 mesh or 74 microns diameter (dry particle size). Such a hydrous aluminum silicate is comprised principally of montmorillonite (90% minimum), with smaller proportions of feldspar, biotite and selenite. A typical analysis, on an "anhydrous" basis, is 63.0% silica, 21.5% alumina, 3.3% of ferric iron (as $Fe_2O_3$), 0.4% of ferrous ron (as FeO), 2.7% of magnesium (as MgO), 2.6% of sodium and potassium (as $Na_2O$). 0.7% of calcium (as CaO), 5.6% of crystal water (as $H_2O$) and 0.7% of trace elements.

Although the western bentonites are preferred it is also possible to utilize other bentonites, such as those which may be made by treating Italian or similar bentonites containing relatively small proportions of exchangeable monovalent metals (sodium and potassium) with alkaline materials, such as sodium carbonate, to increase the cation exchange capacities of such products. It is considered that the $Na_2O$ content of the bentonite should be at least about 0.5%, preferably at least 1% and more preferably at least 2% so that the clay will be satisfactorily swelling, with good softening and dispersing properties in aqueous suspension. Preferred swelling bentonites of the type described above are sold under the trade names Laviosa and Winkelmann, e.g., Laviosa AGB and Winkelmann G 13.

The silicate, which may be employed as a binder to hold together the finely divided bentonite particles in agglomerated form, is preferably a sodium silicate of $Na_2O:SiO_2$ e.g., 1:2.4. The silicate is water soluble and solutions thereof at concentrations up to about 50%, by weight, may be employed in the preparation of the aforementioned bentonite agglomerates, all of such solutions being free flowing, especially at the elevated temperatures to which the silicate solution is preferably heated during the preparation procedure.

The cationic compounds are employed in the fabric softening compositions of the invention in an amount of from about 0.2 to about 16%, and preferably from about 1 to 5%, by weight. In the detergent compositions of the invention, the cationic compounds are present in an amount of from about 0.01 to about 10%, more usually from about 0.05 to 2%, and preferably from about 0.1 to 1%, by weight. A unique characteristic of this invention is the ability to provide effective fabric softening with detergent compositions wherein the concentration of cationic compound is as low as 0.05%, by weight, and occasionally lower. The improved softening effects achieved with the compositions of the invention are most pronounced in laundry washing baths containing relatively low concentrations of laundry detergent compositions, i.e., concentrations of from about 0.1 to 0.7%, by weight. In general, a concentration of cationic compound in the laundry washing bath of from about 10 to about 200 ppm is useful for most laundering operations.

The useful primary, secondary and tertiary amines and their water-soluble salts are generally of the formula $R^1R^2R^3N$, wherein $R^1$ represents an alkyl or alkenyl group containing from about 8 to 22 carbon atoms and $R^2$ and $R^3$ each represent hydrogen or hydrocarbyl groups containing from 1 to 22 carbon atoms, the term "hydrocarbyl group" encompassing alkyl, alkenyl, aryl and alkaryl groups including substituted groups of this type, common substitutents being hydroxy and alkoxy groups.

Within the general description of amines given above, specific examples include primary tallow amine, primary coconut amine, secondary tallow methyl amine, tallow dimethyl amine, tritallow amine, primary tallow amine hydrochloride, and primary coconut amine hydrochloride.

The useful diamine and diammonium salts have the general formulas: $R^1R^2NR^5NR^3R^4$; $[R^1R^2NR^5NR^3R^4R^6]^+X^-$; $[R^1R^2R^3NR^5NR^4R^6]^+X^-$; $[R^1R^2R^3NR^5NR^4R^6R^7]^+X^-$; wherein $R^1$, $R^2$, and $R^3$ are as defined above, $R^4$, $R^6$ and $R^7$ have the same definition as $R^2$ and $R^3$, and $R^5$ is an alkylene chain having from 4 to 6 carbon atoms wherein the middle carbon atoms may be linked to each other by an ether oxygen or by a double or triple bond. $X^-$ is an anion, preferably chloride, bromide, sulfate, methyl sulfate or similar anion.

Specific examples of diamines and diamine salts include N-coco-1,3-diaminopropane, N-tallow-1,3-diaminopropane, N-oleyl-1,3-diaminopropane, N-tallow-1,3-diaminopropane dioleate and N-tallow-1,3-diaminopropane diacetate.

Also suitable for use herein are the ethoxylated amine and diamine salts with fatty alkyl groups of coconut, tallow and stearyl and containing from about 2 to 50 moles of ethylene oxide.

The useful quaternary ammonium compounds are generally of the formula $[R^1R^2R^3R^4N]^+X^-$, wherein $R^1$, $R^2$, $R^3$ and X are as defined above, $R^4$ is an organic radical selected from among those defined for $R^1$, $R^2$ and $R^3$. Although not indicated in the above formula, $R^1$ and/or $R^4$ may be attached to the quaternary nitrogen atom through an ether, alkoxy, ester or amide linkage. Among the quaternary ammonium compounds known to add substantivity to fabrics, particularly fabrics containing substantial amounts of cotton, three basic types are particularly useful for the invention: (1) alkyl dimethyl ammonium compounds; (2) amido alkoxylated ammonium compounds; and (3) alkyl amido imidazolinium compounds. A detailed description of these three types of compounds is set forth by R. Egan in *Journal American Oil Chemists' Society,* January, 1978 (vol. 55), pages 118–121, such disclosure being incorporated herein by reference.

Long chain quaternary ammonium compounds are generally preferred for use herein, namely, compounds wherein the number of carbon atoms is greater than eight. Within the more general description provided above concerning quaternary ammonium compounds useful for the invention, preferred specific quaternary ammonium compounds include di-hydrogenated tallow dimethyl ammonium methyl sulfate; di-hydrogenated tallow dimethyl ammonium chloride, and 1-methyl-1-alkylamidoethyl-2-alkylimidazolinium methyl sulfate wherein the "alkyls" are oleyl or saturated hydrocarbyls derived from tallow or hydrogenated tallow. Dimethyl alkyl benzyl quaternaries that are useful include those wherein the alkyl group is of a mixture of alkyls of 10 to 18 carbon atoms or 12 to 16 carbon atoms, e.g., lauryl, myristal and palmityl. The various materials mentioned above are available commercially from various manufacturers, those from Sherex Chemical Company being identified by tradenames such as Adogen; Arosurf: Variquat; and Varisoft.

The quaternary ammonium salts employed herein are preferably substantially free of a conductive salt; the term "conductive salt" being used herein to refer to salts which are electrically conductive in aqueous solution. The conductive salts generally have a cation anion-bond of at least 50% ionic character as calculated in accordance with the method described in Pauling, "The Nature of the Chemical Bond", 3rd Edition, 1960. By use of the term "substantially free" is meant a concentration of conductive salt less than that present at normal impurity levels in the quaternary ammonium compound. Generally, the concentration of conductive salt is below 1%, by weight.

In accordance with another embodiment of the invention, finely divided softening particles as described above are bonded to the surface of a granular detergent composition which is devoid of a soap to form agglomerate particles consisting of detergent-base granules encapsulated within a surface coating of smectite clay. The agglomerate particles are characterized by an inner portion consisting of the detergent-base granules, and a surface portion contacting and surrounding such inner portion consisting essentially of sofening particles containing at least about 75%, by weight, and preferably greater than about 90%, by weight of a smectite-type clay and less than about 5%, by weight, of surface active detergent compounds, preferably substantially free of such surfactants. A cationic compound as defined above is adsorbed upon the surface portion of the agglomerate particles.

To achieve a substantially continuous external surface of clay on the agglomerate particle, the softening particles employed are as small as possible relative to the detergent-base granules, allowing the softening particles to be closely packed around the granules. The detergent composition granules are preferably spray-dried particles having sizes within mesh Nos. 8 to 100, U.S. Sieve Series. The softening particles are preferably sufficiently small that they pass through a No. 325 mesh screen, U.S. Sieve Series. The weight ratio of detergent composition granules to the clay-containing particles may vary from about 10:1 to about 1:2, preferably from about 5:1 to 1:1. The application of the softening particles to the base detergent granules may be effected by standard agglomeration techniques and equipment. One method that has been found to be especially useful is to mix the desired weights of the detergent composition granules and finely divided clay powder and while mixing, spray water on to the moving surfaces thereof, or more preferably, spray a dilute sodium silicate solution. Spraying may be carried out at room temperature and should be gradual enough so as to prevent any objectionable lumping of the mixture. Mixing will continue in this manner until the clay particles all adhere to the detergent-base granules, after which mixing may be halted and the product may be screened or otherwise classified to be within the desired product size range. The silicate solution employed is normally at a concentration of about 0.05 to 10%, by weight, typically from about 1 to 6%, by weight. The amount of silicate solution applied to the detergent-based granules generally constitutes from about 0.01 to about 2%, by weight. Satisfactory agglomeration and surface coating are obtained at such concentration using suitable agglomerating equipment, such as an O'Brien agglomerator, or a conventional inclined drum equipped with spray nozzles, baffles, etc. The silicate concentration should not be so high as to inhibit dispersion of the softening particles in the wash solution when the product is employed in laundry operations. Although it is preferred that silicate by employed in the agglomerating spray, useful product is obtainable by utilizing water alone as an agglomerating or binding agent or by employing aqueous solutions of other binders, such as gums, resins and surface active agents.

The adsorption of the cationic compound upon the surface of the agglomerate particle is carried out using the same methods described herein with regard to providing a cationic surface to the softening particles. The resulting agglomerate particles are useful laundry products in which the detergent-base granule dissolves and functions in the standard manner in the wash solution while the softening particles become dispersed in the wash solution where they serve as fabric softeners in accordance with the invention.

As noted above, the softening compositions of the invention are prepared by a method in which substantially all of the cationic compound in the softening composition is adsorbed on the surface of the softening particles. The process is preferably effected by spraying a non-aqueous solution of a cationic compound from a pressurized nozzle over the clay particles contained in a rotating drum, or a tube inclined at a slight angle, such as, from about 5° to 15°, the rotational speed being suitably from about 5 to 100 rpm. Alternatively, spraying may be effected while the particles are transported on a moving belt such as a conveyor belt. In accordance with another embodiment of the process of preparation, the particles are placed on a vibrating conveyor belt which is continuously wetted with a solution or suspension of the cationic compound, the effect of the vibration being to impart at least a partial coating of the cationic solution or suspension upon the surface of the particles.

The laundry detergent compositions with which the present fabric softening compositions may be incorporated or with which it may be employed may contain one or more surface active agents selected from the group consisting of anionic, nonionic, cationic, ampholytic and zwitterionic detergents. The synthetic organic detergents employed in the practice of the invention may be any of a wide variety of such compounds which are well known and are described at length in the text "Surface Active Agents and Detergents", Vol. II, by Schwartz, Perry and Berch, published in 1958 by Interscience Publishers, the relevant disclosures of which are hereby incorporated by reference.

The detergent compositions of the invention preferably employ one or more anionic detergent compounds as the primary surfactants. The anionic detergent may be supplemented, if desired, with another type of surfactant, preferably an ampholytic detergent. The use of a nonionic detergent is generally less preferred for the present invention, however, when used in combination with a detergent builder salt, nonionic detergents can be advantageously utilized in the present compositions.

Among the anionic surface active agents useful in the present invention are those surface active compounds which contain an organic hdyrophobic group containing from about 8 to 26 carbon atoms and preferably from about 10 to 18 carbon atoms in their molecular structure and at least one water-solubilizing group selected from the group of sulfonate, sulfate, carboxylate, phosphonate and phosphate so as to form a water-soluble detergent.

Examples of suitably anionic detergents include soaps, such as, the water-soluble salts (e.g., the sodium, potassium, ammonium and alkanol-ammonium salts) of higher fatty acids or resin salts containing from about 8 to 20 carbon atoms and preferably 10 to 18 carbon atoms. Suitable fatty acids can be obtained from oils and waxes of animal or vegetable origin, for example, tallow, grease, coconut oil and mixtures thereof. Particularly useful are the sodium and potassium salts of the fatty acid mixtures derived from coconut oil and tallow, for example, sodium coconut soap and potassium tallow soap.

The anionic class of detergents also includes the water-soluble sulfated and sulfonated detergents having an aliphatic, preferably an alkyl radical containing from about 8 to 26, and preferably from about 12 to 22 carbon atoms. (The term "alkyl" includes the alkyl portion of the higher acyl radicals). Examples of the sulfonated anionic detergents are the higher alkyl mononuclear aromatic sulfonates such as the higher alkyl benzene sulfonates containing from about 10 to 16 carbon atoms in the higher alkyl group in a straight or branched chain, such as, for example, the sodium, potassium and ammonium salts of higher alkyl benzene sulfonates, higher alkyl toluene sulfonates and higher alkyl phenol sulfonates.

Other suitable anionic detergents are the olefin sulfonates including long chain alkene sulfonates, long chain hydroxyalkane sulfonates or mixtures of alkene sulfonates and hydroxyalkane sulfonates. The olefin sulfonate detergents may be prepared in a conventional manner by the reaction of $SO_3$ with long chain olefins containing from about 8 to 25, and preferably from about 12 to 21 carbon atoms, such olefins having the formula $RCH{=}CHR_1$ wherein R is a higher alkyl group of from about 6 to 23 carbons and $R_1$ is an alkyl group containing from about 1 to 17 carbon atoms, or hydrogen to form a mixture of sultones and alkene sulfonic acids which is then treated to convert the sultones to sulfonates. Other examples of sulfate or sulfonate detergents are paraffin sulfonates containing from about 10 to 20 carbon atoms, and preferably from about 15 to 20 carbon atoms. The primary paraffin sulfonates are made by reacting long chain alpha olefins and bisulfites. Paraffin sulfonates having the sulfonate group distributed along the paraffin chain are shown in U.S. Pat. Nos. 2,503,280; 2,507,088; 3,260,741; 3,372,188 and German Pat. No. 735,096.

Other suitable anionic detergents are sulfated ethoxylated higher fatty alcohols of the formula $RO(C_2H_4O)_mSO_3M$, wherein R is a fatty alkyl of from 10 to 18 carbon atoms, m is from 2 to 6 (preferably having a value from about 1/5 to ½ the number of carbon atoms in R) and M is a solubilizing salt-forming cation, such as an alkali metal, ammonium, lower alkylamino or lower alkanolamino, or a higher alkyl benzene sulfonate wherein the higher alkyl is of 10 to 15 carbon atoms. The proportion of ethylene oxide in the polyethoxylated higher alkanol sulfate is preferably 2 to 5 moles of ethylene oxide groups per mole of anionic detergent, with three moles being most preferred, especially when the higher alkanol is of 11 to 15 carbon atoms. To maintain the desired hydrophilelipophile balance, when the carbon atom content of the alkyl chain is in the lower portion of the 10 to 18 carbon atom range, the ethylene oxide content of the detergent may be reduced to about two moles per mole whereas when the higher alkanol is of 16 to 18 carbon atoms in the higher part of the range, the number of ethylene oxide groups may be increased to 4 or 5 and in some cases to as high as 8 or 9. Similarly, the salt-forming cation may be altered to obtain the best solubility. It may be any suitably solubilizing metal or radical but will most frequently be alkali metal, e.g., sodium, or ammonium. If lower alkylamine or alkanolamine groups are utilized the alkyls and alkanols will usually contain from 1 to 4 carbon atoms and the amines and alkanolamines may be mono- di- and tri-substituted, as in monoethanolamine, diisopropanolamine and trimethylamine. A preferred polyethoxylated alcohol sulfate detergent is available from Shell Chemical Company and is marketed as Neodol 25-3S.

The most highly preferred water-soluble anionic detergent compounds are the ammonium and substituted ammonium (such as mono, di and tri-ethanolamine), alkali metal (such as, sodium and potassium) and alkaline earth metal (such as, calcium and magnesium) salts of the higher alkyl benzene sulfonates, olefin sulfonates and higher alkyl sulfates. Among the abovelisted anionics, the most preferred are the sodium linear alkyl benzene sulfonates (LABS), and especially those wherein the alkyl group is a straight chain alkyl radical of 12 or 13 carbon atoms.

The nonionic synthetic organic detergents are characterized by the presence of an organic hydrophobic group and an organic hydrophilic group and are typically produced by the condensation of an organic aliphatic or alkyl aromatic hydrophobic compound with ethylene oxide (hydrophilic in nature). Practically any hydrophobic compound having a carboxy, hydroxy, amido or amino group with a free hydrogen attached to the nitrogen can be condensed with ethylene oxide or with the polyhydration product thereof, polyethylene glycol, to form a nonionic detergent. The length of the hydrophilic or polyoxyethylene chain can be readily adjusted to achieve the desired balance between the hydrophobic and hydrophilic groups.

The nonionic detergent employed is preferably a poly-lower alkoxylated higher alkanol wherein the alkanol is of 10 to 18 carbon atoms and wherein the number of moles of lower alkylene oxide (of 2 or 3 carbon atoms) is from 3 to 12. Of such materials it is preferred to employ those wherein the higher alkanol is a higher fatty alcohol of 11 to 15 carbon atoms and which contain from 5 to 9 lower alkoxy groups per mole. Preferably, the lower alkoxy is ethoxy but in some instances it may be desirably mixed with propoxy, the latter, if present, usually being a minor (less than 50%) constituent. Exemplary of such compounds are those wherein the alkanol is of 12 to 15 carbon atoms and which contain about 7 ethylene oxide groups per mole, e.g., Neodol ®25-7 and Neodol 23-6.5, which products are made by Shell Chemical Company, Inc. The former is a condensation product of a mixture of higher fatty alcohols averaging about 12 to 15 carbon atoms, with about 7 moles of ethylene oxide and the latter is a corresponding mixture wherein the carbon atom content of the higher fatty alcohol is 12 to 13 and the number of ethylene oxide groups per mole averages about 6.5. The higher alcohols are primary alkanols. Other examples of such detergents include Tergitol ®15-S-7 and Tergitol 15-S-9, both of which are linear secondary alcohol ethoxylates made by Union Carbide Corporation. The former is a mixed ethoxylation product of an 11 to 15 carbon atom linear secondary alkanol with seven moles of ethylene oxide and the latter is a similar product but with nine moles of ethylene oxide being reacted. Also useful in the present compositions are the higher molecular weight nonionics, such as Neodol 45-11, which are similar ethylene oxide condensation products of higher fatty alcohols, the higher fatty alcohol being of 14 to 15 carbon atoms and the number of ethylene oxide groups per mole being about 11. Such products are also made by Shell Chemical Company.

Zwitterionic detergents such as the betaines and sulfobetaines having the following formula are also useful:

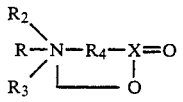

wherein R is an alkyl group containing from about 8 to 18 carbon atoms, $R_2$ and $R_3$ are each an alkyl or hydroxyalkyl group containing about 1 to 4 carbon atoms, $R_4$ is an alkylene or hydroxyalkylene group containing 1 to 4 carbon atoms, and X is C or S:O. The alkyl group can contain one or more intermediate linkages such as amido, ether, or polyether linkages or nonfunctional substituents such as hydroxyl or halogen which do not substantially affect the hydrophobic character of the group. When X is C, the detergent is called a betaine; and when X is S:O, the detergent is called a sulfobetaine or sultaine.

Cationic surface active agents may also be employed. They comprise surface active detergent compounds which contain an organic hydrophobic group which forms part of a cation when the compound is dissolved in water, and an anionic group. Typical cationic surface active agents are amine and quaternary ammonium compounds.

Examples of suitable synthetic cationic detergents include: normal primary amines of the formula $RNH_2$ wherein R is an alkyl group containing from about 12 to 15 atoms; diamines having the formula $RNHC_2H_4NH_2$ wherein R is an alkyl group containing from about 12 to 22 carbon atoms, such as N-2-aminoethyl-stearyl amine and N-2-aminoethyl myristyl amine; amide-linked amines such as those having the formula $R_1CONHC_2H_4NH_2$ wherein $R_1$ is an alkyl group containing about 8 to 20 carbon atoms, such as N-2-amino ethylstearyl amide and N-amino ethylmyristyl amide; quaternary ammonium compounds wherein typically one of the groups linked to the nitrogen atom is an alkyl group containing about 8 to 22 carbon atoms and three of the groups linked to the nitrogen atom are alkyl groups which contain 1 to 3 carbon atoms, including alkyl groups bearing inert substituents, such as phenyl groups, and there is present an anion such as halogen, acetate, methosulfate, etc. The alkyl group may contain intermediate linkages such as amide which do not substantially affect the hydrophobic character of the group, for example, stearyl amido propyl quaternary ammonium chloride. Typical quaternary ammonium detergents are ethyl-dimethyl-stearyl-ammonium chloride, benzyl-dimethyl-stearyl ammonium chloride, trimethyl-stearyl ammonium chloride, trimethyl-cetyl ammonium bromide, dimethyl-ethyl-lauryl ammonium chloride, dimethyl-propyl-myristyl ammonium chloride, and the corresponding methosulfates and acetates.

Ampholytic detergents are also suitable for the invention. Ampholytic detergents are well known in the art and many operable detergents of this class are disclosed by Schwartz, Perry and Berch in the aforementioned "Surface Active Agents and Detergents." Examples of suitable amphoteric detergents include: alkyl betaiminodipropionates, $RN(C_2H_4COOM)_2$; alkyl beta-amino propionates, $RN(H)C_2H_4COOM$; and long chain imidazole derivatives having the general formula:

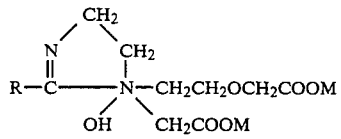

wherein in each of the above formulae R is an acyclic hydrophobic group containing from about 8 to 18 carbon atoms and M is a cation to neutralize the charge of the anion. Specific operable amphoteric detergents include the disodium salt of undecylcycloimidinium-ethoxyethionic acid-2-ethionic acid, dodecyl beta alanine, and the inner salt of 2-trimethylamino lauric acid.

The bleaching detergent compositions of the invention optionally contain a detergent builder of the type commonly used in detergent formulations. Useful builders include any of the conventional inorganic water-soluble builder salts, such as, for example, water-soluble salts of phosphates, pyrophosphates, orthophosphates, polyphosphates, silicates, carbonates, and the like. Organic builders include water-soluble phosphonates, polyphosphonates, polyhydroxysulfonates, polyacetates, carboxylates, polycarboxylates, succinates and the like.

Specific examples of inorganic phosphate builders include sodium and potassium tripolyphosphates, pyrophosphates and hexametaphosphates. The organic polyphosphonates specifically include, for example, the sodium and potassium salts of ethane 1-hydroxy-1,1-diphosphonic acid and the sodium and potassium salts of ethane-1,1,2-triphosphonic acid. Examples of these and other phosphorous builder compounds are disclosed in U.S. Pat. Nos. 3,213,030; 3,422,021; 3,422,137 and 3,400,176. Pentasodium tripolyphosphate and tetrasodium pyrophosphate are especially preferred water-soluble inorganic builders.

Specific examples of non-phosphorous inorganic builders include water-soluble inorganic carbonate, bicarbonate and silicate salts. The alkali metal, for example, sodium and potassium, carbonates, bicarbonates and silicates are particularly useful herein.

Water-soluble organic builders are also useful. For example, the alkali metal, ammonium and substituted ammonium acetates, carboxylates, polycarboxylates and polyhydroxysulfonates are useful builders for the compositions and processes of the invention. Specific examples of acetate and polycarboxylate builders include sodium, potassium, lithium, ammonium and substituted ammonium salts of ethylene diaminetetracetic acid, nitrilotriacetic acid, benzene polycarboxylic(i.e. penta- and tetra-)acids, carboxymethoxysuccinic acid and citric acid.

Water-insoluble builders may also be used, particularly, the complex silicates and more particularly, the complex sodium alumino silicates such as, zeolites, e.g., zeolite 4A, a type of zeolite molecule wherein the univalent cation is sodium and the pore size is about 4 Angstroms. The preparation of such type zeolite is described in U.S. Pat. No. 3,114,603. The zeolites may be amorphous or crystalline and have water of hydration as known in the art.

The use of an inert, water-soluble filler salt is desirable in the laundering compositions of the invention. A preferred filler salt is an alkali metal sulfate, such as, potassium or sodium sulfate, the latter being especially preferred.

Various adjuvants may be included in the laundry detergent compositions of the invention. In general, these include perfumes; colorants, e.g., pigments and dyes; bleaches, such as, sodium perborate, antiredeposition agents, such as, alkali metal salts of carboxymethylcellulose; optical brighteners, such as, anionic, cationic or nonionic brighteners; foam stabilizers, such as alkanolamides, and the like, all of which are well-known in the fabric washing art for use in detergent compositions. Flow promoting agents, commonly referred to as flow aids, may also be employed to maintain the particulate compositions as free-flowing beads or powder. Starch derivatives and special clays are commercially available as additives which enhance the flowability of otherwise tacky or pasty particulate compositions, two of such clay additives being presently marketed under the tradenames "Satintone" and "Microsil".

The fabric softening compositions of the invention are advantageously incorporated into laundry detergent compositions which are specifically intended for hand-wash operations. There are three general types of such hand-wash detergents which are particularly useful for the present invention. The first type typically comprises: (a) from about 5 to about 50%, by weight, of an alkyl benzene sulfonate detergent; (b) from about 0 to about 20%, by weight, of a nonionic detergent compound; (c) from about 0 to about 20%, by weight, of a soap; (d) from about 5 to about 50%, by weight, of pentasodium tripolyphosphate; (e) from about 5 to about 25%, by weight, of sodium silicate; (f) from about 0 to about 1%, by weight, of carboxymethylcellulose; and, (g) the balance comprising water, sodium sulfate and optionally minor components such as perfume and brighteners.

The second type of hand-wash detergent composition comprises: (a) from about 5 to about 25%, by weight, of a nonionic detergent compound: (b) from about 5 to about 80%, by weight, of a detergent builder salt; (c) from about 0 to 10%, by weight, of sodium silicate; (d) from about 0 to 5%, by weight, of a soap; and (e) the balance comprising water and optionally minor components such as perfume and optical brighteners. The third type of hand-wash composition comprises: (a) at least 90%, by weight, of a soap; (b) from about 0 to about 1%, by weight, of carboxymethylcellulose; and, (c) the balance comprising water and optionally minor components such as perfume and optical brighteners.

The following examples are provided to further illustrate the invention. It is to be understood, however, that such examples are intended solely for purposes of illustration and the invention is not to be limited thereby.

EXAMPLE 1

Agglomerates of Thixojel No. 1[(1)] clay were used in the present examples and were prepared by the procedure described below wherein the following components were used: Thixojel No. 1 clay (325 mesh) and an aqueous agglomerating solution containing 7% of sodium silicate in a ratio of $Na_2O:SiO_2$ of about 1:2.4.

[1]A tradename of a Wyoming bentonite clay sold by Georgia Kaolin Co., Elizabeth, N.J.

The agglomerates were prepared in a rotary drum characterized by a 19.5 inch diameter, a 23.5 inch length and an axis of rotation adjustable between ten and ninety degrees from the vertical.

9.1 kg. of the Thixojel No. 1 clay was charged into the above-described rotary drum which was aligned at an angle of 20 degrees from the vertical. 3.2 kg. of the aqueous silicate solution at a temperature of 43° C. was sprayed on to the clay while the drum was rotating at about 6 rpm. The axis of the rotary drum was then adjusted to an angle of 70 degrees from the vertical and an additional 3.2 kg. of silicate solution was sprayed on to the clay. The resulting wet agglomerates of clay were transferred in 2 kg. portions to an Aeromatic ST-5 (tradename) fluid bed dryer, manufactured by Aeromatic Corp., Summerville, N.J., and dried to approximately 10 wt.% moisture using an air flow rate of about 6,000 liters per minute and an air inlet temperature of 71° C. Drying was effected in about 15 minutes. The dried material was then passed through a Stokes granulater having a 40 mesh screen, the product particle size being between 40–100 mesh. The fines passing through a 100 mesh screen were recycled to the rotary drum.

Surface modified clay particles in accordance with the invention were used in the present examples and prepared as follows:

100 g. of the bentonite agglomerates prepared as described above were put into a one-liter laboratory-model drum which was rotated by a motor at about 10 rpm. Two grams of Varisoft 3690[1] were added dropwise to the clay while the drum was rotating so as to simulate in the laboratory-scale equipment the effect of spraying the QA compound upon the clay. The amount of QA compound relative to the clay (based on the active ingredient in the Varisoft 3690) is 0.15 g./10 g. clay. The resulting particles are referred to in the examples as "coated" particles of agglomerated clay.

[1]Methyl (1) oleyl amido ethyl (2) oleyl imidazolinium-methyl sulfate (75% active ingredients in 25% isopropanol) manufactured by Sherex Chemical Company, Dublin, Ohio.

A granular detergent formulation "A" was used in the tests described below and had the following composition:

COMPOSITION A

| Component | Weight Percent |
|---|---|
| Sodium tridecyl benzene sulfonate | 15 |
| Nonionic surfactant ($C_{12}$—$C_{15}$ ethoxylated primary alcohol, 6.5 moles EO/mole alcohol) | 0.5 |
| Pentasodium tripolyphosphate (TPP) | 33 |
| Sodium silicate ($1Na_2O:2.4SiO_2$) | 7 |
| Sodium sulfate | 35 |
| Moisture | 9 |
| Optical brighteners (Tinopal 5BM) | 0.2 |
| Carboxymethyl cellulose | 0.25 |

Comparative tests were run on swatches of terry cloths using in one test a wash solution containing only composition A; in the second test, a wash solution was used containing composition A plus the above-described particles of agglomerated clay; and in the third test, the wash solution contained detergent composition A plus coated particles of agglomerated clay. Washing was carried out in a one-liter solution at 70° F. The wash conditions comprised a 10-minute soak period followed by a 1-minute hand wash. The washed and dried swatches were graded tactilely for softness and assigned an integer grade from 1–10 on a linear scale, the higher grades corresponding to the softer materials. The results of the softening tests appear in Table I.

TABLE I

| Experiment | Composition of wash solution | Softness Rating |
|---|---|---|
| 1 | 3.5 g/l Composition A | 1 |
| 2 | 3.5 g/l Composition A + 0.7 g/l Thixojel agglomerates | 6 |
| 3 | 3.5 g/l Composition A + 0.7 g/l coated Thixojel agglomerates | 8 |

As evident from the data in Table I, the use of the fabric softening composition of the invention (Experiment 3) provided a marked improvement in softness as compared to the use of Thixojel agglomerates having no surface coating of QA compound (Experiment 2).

EXAMPLE 2

Thixojel No. 1 clay was agglomerated as described in example 1 and coated with Varisoft 475[1] following the general procedure set forth in example 1. Comparative tests were run in Experiments 4–7 described below on swatches of terry cloths using the washing conditions and softness rating described in example 1. In Experiment 4, the wash solution contained a detergent composition, but no clay or QA compound; in Experiment 5, uncoated clay agglomerates were added to the detergent solution; in Experiment 6, coated agglomerates and the QA compound were added to the wash solution as separate components. The results of the softening tests appear in Table II below.

[1]Methyl (1) tallow amido ethyl (2) tallow imidazolinium-methyl sulfate (75% active ingredients in 25% propylene glycol) manufactured by Sherex Chemical Company, Dublin, Ohio.

TABLE II

| Experiment | Composition of Wash Solution | Softness Rating |
|---|---|---|
| 4 | 3.5 g/l Composition A | 1 |
| 5 | 3.5 g/l Composition A 0.7 g/l Thixojel agglomerates | 5 |
| 6 | 3.5 g/l Composition A 0.7 g/l coated Thixojel agglomerates (containing 0.014 g. Varisoft 475) | 8 |
| 7 | 3.5 g/l Composition A 0.7 g/l Thixojel + 0.014 g/l Varisoft 475 | 6 |

As seen from Table II, the wash solution containing the softening composition of the invention (Experiment 6) provided significantly improved softening relative to the use of uncoated clay (Experiment 5) and/or the use of Thixojel and QA compound as independent components of the wash solution (Experiment 7). Thus, Experiment 7 demonstrates that the surprisingly improved softening effects which are provided by the softening compositions of the invention (Experiment 6) cannot be duplicated by simply adding the individual components of the present compositions to the wash solution.

Improved softening is also achieved in accordance with the invention by coating the Thixogel agglomerates described in example 1 with one of the following amines, diamines and diamine salts: primary tallow amine, secondary tallow methyl amine, tritallow amine, N-coco-1,3-diaminopropane, N-tallow-1,3-diaminopropane and N-tallow-1,3-diaminopropane diacetate.

What is claimed is:

1. A fabric softening composition for use in admixture with a particulate laundry detergent composition comprising: (i) discrete softening particles containing at least about 90%, by weight, of a smectite-type clay, and less than about 5%, by weight, of detergent surface active agents selected from the group consisting of anionic, nonionic, ampholytic, and zwitterionic detergents; and (ii) a cationic compound selected from the group consisting of primary, secondary and tertiary amines and their water-soluble salts, diamine and diammonium salts, and quaternary ammonium, phosphonium and sulfonium compounds, substantially all of said cationic compound being adsorbed upon the surface of said particles, the weight ratio of softening particles to cationic compound being from about 500:1 to about 10:1.

2. A composition in accordance with claim 1 wherein the smectite-type clay is a bentonite clay.

3. A composition in accordance with claim 1 wherein the weight ratio of softening particles to cationic compound is from about 200:1 to about 25:1.

4. A composition in accordance with claim 1 wherein the amount of cationic compound is from about 1 to 5%, by weight, of said softening composition.

5. A composition in accordance with claim 1 wherein said cationic compound is a quaternary ammonium compound.

6. A composition in accordance with claim 5 wherein said quaternary ammonium compound contains more than eight carbon atoms.

7. A composition in accordance with claim 1 which is substantially free of anionic, nonionic, ampholytic and zwitterionic detergents.

8. A laundry detergent composition which comprises a fabric softening composition in accordance with claim 1 in combination with one or more surface active detergent compounds.

9. A particulate laundry detergent composition which comprises:

(a) from about 3 to about 50%, by weight, of a fabric softening composition comprising (i) discrete softening particles containing at least about 90%, by weight, of a smectite-type clay, and less than about 5%, by weight, of detergent surface active agents selected from the group consisting of anionic, nonionic, cationic and zwitterionic detergents; and (ii) a cationic compound selected from the group consisting of primary, secondary and tertiary amines and their water-soluble salts, diamine and diammonium salts, and quaternary ammonium, phosphonium and sulfonium compounds, substantially all of said cationic compound being adsorbed upon the surface of said particles, the weight ratio of softening particles to cationic compound being from about 500:1 to about 10:1;

(b) from about 2 to about 50%, by weight, exclusive of any detergent compound in said softening particles, of one or more surface active detergent compounds selected from the group consisting of anionic, nonionic, cationic, ampholytic and zwitterionic detergents;

(c) from about 1 to about 70%, by weight, of a detergent builder salt; and (d) the balance comprising water and optionally a filler salt.

10. A laundry detergent composition in accordance with claim 9 wherein the weight ratio of softening particles to cationic compound is from about 200:1 to about 25:1.

11. A laundry detergent composition in accordance with claim 9 wherein the amount of cationic compound is from about 0.05 to 2%, by weight, of said detergent composition.

12. A laundry detergent composition in accordance with claim 9 wherein the smectite-type clay is a bentonite clay.

13. A laundry detergent composition in accordance with claim 8 wherein said fabric softening composition is combined with a detergent composition comprising:

(a) from about 5 to about 50%, by weight, of an alkyl benzene sulfonate detergent;

(b) from about 0 to about 20%, by weight, of a nonionic detergent compound;

(c) from about 0 to about 20%, by weight, of a soap;

(d) from about 5 to about 50%, by weight, of pentasodium tripolyphosphate;

(e) from about 5 to about 25%, by weight, of sodium silicate;

(f) from about 0 to about 1%, by weight, of carboxymethylcellulose; and, (g) the balance comprising water, sodium sulfate and optionally perfume and optical brighteners.

14. A laundry detergent composition in accordance with claim 8 wherein said fabric softening composition is combined with a detergent composition comprising:

(a) from about 5 to about 25%, by weight, of a nonionic detergent compound;

(b) from about 5 to about 80%, by weight, of a detergent builder salt;

(c) from about 0 to about 10%, by weight, of sodium silicate;

(d) from about 0 to about 5%, by weight, of a soap; and, (e) the balance comprising water and optionally perfume and optical brighteners.

15. A laundry detergent composition in accordance with claim 8 wherein said fabric softening composition is combined with a detergent composition comprising:

(a) at least 90%, by weight, of a soap;

(b) from about 0 to about 1%, by weight, of carboxymethyl cellulose; and, (c) the balance comprising water and optionally perfume and optical brighteners.

16. A laundry detergent product comprising:

(a) agglomerate particles which contain as individual components thereof (i) softening particles containing at least about 90%, by weight, of a smectite-type clay; and (ii) granules of a detergent composition devoid of a soap; each of said agglomerate particles being comprised of an inner portion and a surface portion, the inner portion of the agglomerate particle being contiguous with and essentially surrounded by the surface portion, said inner portion consisting essentially of said granular detergent composition and said surface portion consisting essentially of said softening particles; and (b) a cationic compound selected from the group consisting of primary, secondary and tertiary amines and their water-soluble salts, diamine and diammonium salts and quaternary ammonium, phosphonium and sulfonium compounds, substantially all of said cationic compound being adsorbed upon the surface portion of said agglomerate particles.

17. A laundry detergent product as in claim 16 wherein said softening particles contain less than about 5%, by weight, of surface active detergent compounds selected from the group consisting of anionic, nonionic, ampholytic and zwitterionic detergents.

18. A laundry detergent product as in claim 16 wherein said cationic compound is a quaternary ammonium compound.

19. A process for preparing a fabric softening composition containing (i) discrete softening particles containing at least about 75%, by weight, of a smectite-type clay, and less than about 5%, by weight, of detergent surface active agents selected from the group consisting of anionic, nonionic, ampholytic and zwitterionic detergents; and (ii) a cationic compound selected from the group consisting of primary, secondary and tertiary amines and their water-soluble salts, diamine and diammonium salts, and quaternary ammonium, phosphonium and sulfonium compounds, which process comprises the step of:

(a) providing discrete softening particles as set forth in (i); and (b) contacting said particles with said cationic compound such that substantially all of said cationic compound is adsorbed upon the surface of said particles, the weight ratio of softening particles to cationic compound being from about 500:1 to about 10:1.

20. A process in accordance with claim 19 wherein the weight ratio of softening particles to cationic compound is from about 200:1 to about 25:1.

21. A process in accordance with claim 19 wherein the amount of cationic compound is from about 1 to 5%, by weight, of said softening composition.

22. A process in accordance with claim 19 wherein the smectite-type clay is a bentonite clay.

23. A process in accordance with claim 19 wherein said cationic compound is a quaternary ammonium compound.

24. A process in accordance with claim 23 wherein said softening particles are contacted with a non-aqueous solution or suspension containing said quaternary ammonium compound.

25. A process in accordance with claim 23 wherein said solution or suspension is sprayed upon the surface of said particles.

26. A process for imparting softness to fabrics which comprises contacting said fabrics with an aqueous dispersion of a fabric softening composition, wherein said softening composition comprises: (i) discrete softening particles containing at least about 90%, by weight, of a smectite-type clay, and less than about 5%, by weight, of detergent surface active agents selected from the group consisting of anionic, nonionic, ampholytic and zwitterionic detergents; and (ii) a cationic compound selected from the group of primary, secondary and tertiary amines and their water-soluble salts, diamine and diammonium salts, and quaternary ammonium, phosphonium and sulfonium compounds, substantially all of said cationic compound being adsorbed upon the surface of said particles.

27. A process in accordance with claim 26 wherein said cationic compound is a quaternary ammonium compound.

28. A process in accordance with claim 26 wherein the smectite-type clay is a bentonite clay.

29. A process in accordance with claim 26 wherein the amount of cationic compound is from about 1 to 5%, by weight of said softening composition.

* * * * *